United States Patent [19]

Barber

[11] Patent Number: 4,834,858

[45] Date of Patent: May 30, 1989

[54] ELECTROLYTIC REACTOR

[75] Inventor: James J. Barber, Arlington, Mass.

[73] Assignee: Montvale Process Company, Inc., Westport, Conn.

[21] Appl. No.: 172,254

[22] Filed: Mar. 23, 1988

[51] Int. Cl.[4] ..... C25D 17/00; C25B 9/00; C25B 15/08

[52] U.S. Cl. ..... 204/225; 204/269; 204/275; 204/278

[58] Field of Search ..... 204/272, 277, 278, 225, 204/269, 275

[56] References Cited

U.S. PATENT DOCUMENTS

| | | | |
|---|---|---|---|
| 3,953,315 | 4/1976 | Spaller, Jr. | 204/272 |
| 3,957,596 | 5/1976 | Seto | 204/272 X |
| 4,253,925 | 3/1981 | Mason | 204/272 X |
| 4,686,018 | 8/1987 | Chaussard | 204/272 X |

*Primary Examiner*—Donald R. Valentine
*Attorney, Agent, or Firm*—William C. Long

[57] ABSTRACT

A high pressure electrolytic cell and an overall system incorporating one or more of such cells are provided, especially adapted for the electrolytic tetramerization of carbon monoxide.

5 Claims, 3 Drawing Sheets

ELECTROLYTIC REACTOR

BACKGROUND OF THE INVENTION

1. Field of the Invention

The present invention relates to an electrolytic cell which is especially adapted for the high pressure electrolytic coupling of carbon monoxide to squaric acid, and a system incorporating such cell.

2. Description of Related Art

Processes are known whereby carbon monoxide can be electrolytically coupled to form squaric acid.

U.S. Pat. No. 3,833,489 to Ercoli et al. describes the electrochemical cyclotetramerization of carbon monoxide to produce the squarate ion. Operations using corrodable or non-corrodable anodes are described. Solvents such as amides of phosphoric acid or carboxylic acids, aliphatic ethers, cyclic ethers, liquid polyethers and anhydrous ammonia are taught. Materials such as halides are added to enhance conductivity.

The apparatus described in the above patent is a pressure resistant electrolytic cell in which may be arranged a cylindrical graphite anode and a stainless steel cathode which is also the container. A stirrer is provided and there are introduced into the cell under nitrogen atmosphere auxiliary electrolyte and solvent. The cell is sealed and immersed in a temperature control bath. Carbon monoxide is charged until a certain pressure is attained and direct current is then passed through the solution for the time required for the reaction Upon completion of the reaction, current circulation is stopped, gas is discharged and the suspension in the cathodic zone is removed and subjected to various recovery and work-up procedures.

It will be apparent that the apparatus described above is not suitable for continuous, commercial-type operations.

U.S. Pat. Nos. 4,461,681 and 4,523,980 of James J. Barber are directed to the electrolytic tetramerization of carbon monoxide using anhydrous nitrile solvents and to the separation and recovery of high purity squaric acid from squarate containing solids from the electrolytic reaction. The apparatus described for the electrolytic tetramerization is, illustratively, a Paar bomb equipped with a magnetic stirring vane. An aluminum, titanium or magnesium rod connected via a bulkhead electrical adapter to the positive pole of a power supply is used as anode. After being charged with solvent and auxiliary electrolyte, the bomb was sealed, connected to the negative pole of the power supply, and pressurized with carbon monoxide. Direct current was applied until a certain charge had passed. Gas was vented, and solids were separated as by centrifugation.

It will be apparent that improvements in the apparatus described above are desirable for continuous commercial operations.

SUMMARY OF THE INVENTION

The present invention relates to a novel electrolytic cell which is especially adapted for continuous, high pressure electrolytic coupling or tetamerization of carbon monoxide to the squarate ion.

DETAILED DESCRIPTION

Figure 1:
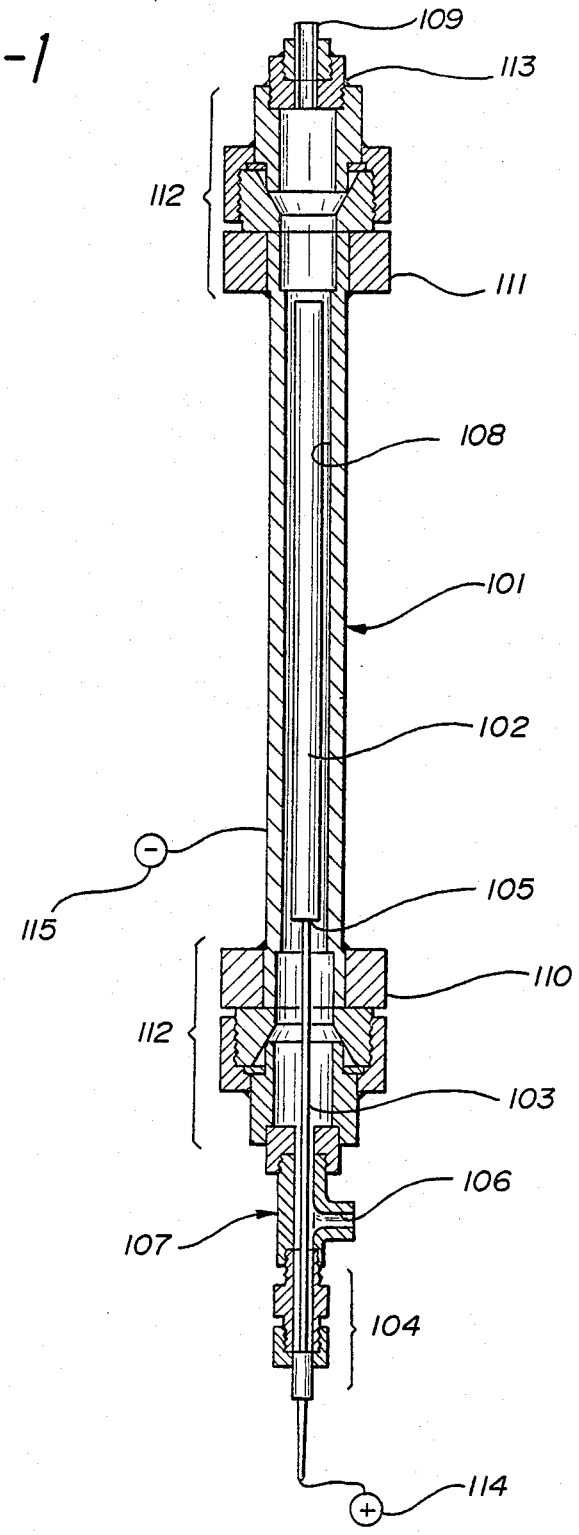
FIG. 1 is a sectional view of an embodiment of the electrolytic cell of the invention.

Referring to FIG. 1, cathode 101 is a conductive element capable of withstanding high pressure and corrosive materials. Preferably cathode 101 is a pipe, for example, a 316 stainless steel pipe although other materials can also be used. The dimensions of the cathode are not critical aside from the constraints imposed by high pressure operations, but rather will depend upon factors such as production capacity.

Positioned within and along the center longitudinal axis of cathode 101 is anode 102 which is a rod of anode material which dissolves under the application of a positive charge. Preferably anode 102 is an aluminum or magnesium rod.

Current is passed to anode 102 by current feeder 103 which enters the cell through an electrically insulated gland 104, which is preferably a Conax gland, containing a teflon sealant ring. Other glands which function in an equivalent way can be employed Current feeder 103 is constructed of stiff, electrically conducting material such as stainless steel and is appropriately wrapped with an insulating layer of tape, tubing or both—e.g., Teflon tape, heat shrink plastic tubing, and the like which is of a type that is not attacked by the electrolyte mixture during use.

Anode 102 is securely fastened to current feeder 103 at 104 by any convenient means including forcing the current feeder into a smooth-bore hole in the anode or screwing a threaded current feeder into a threaded hole in the anode. Use of threaded parts is especially desirable since ease of anode replacement is enhanced.

In an especially preferred practice, anode 102 is threaded such that it can be advanced within the reaction zone without interrupting operation thus providing a continuous source of anode material to replenish that which is consumed without process disruption.

Means are provided for introduction of electrolyte solution into the cathode 101 at 106. Preferably stainless steel tee 107 is provided through which electrolyte is introduced into the annular reaction zone 108 which is defined by the inner wall of cathode pipe 101 and the outer surface of anode rod 102.

Means are provided for the withdrawal of product-containing electrolyte at 109. Preferably, pipe 101 is flanged at 110 and 111 with appropriate compression fittings 112 and reducing bushing 113 provided to insure the integrity of the system.

Preferably, the electrolytic cell is operated with cathode 101 in the vertical position with electrolyte entering at the bottom and passing upwardly to exit at the top in order to avoid accumulation of squarate solids. Other positions can, however, be employed.

The current feeder 103 is connected to a positive source of direct electrical current (not shown) while cathode 101 is connected to the negative pole (not shown).

Figure 2:
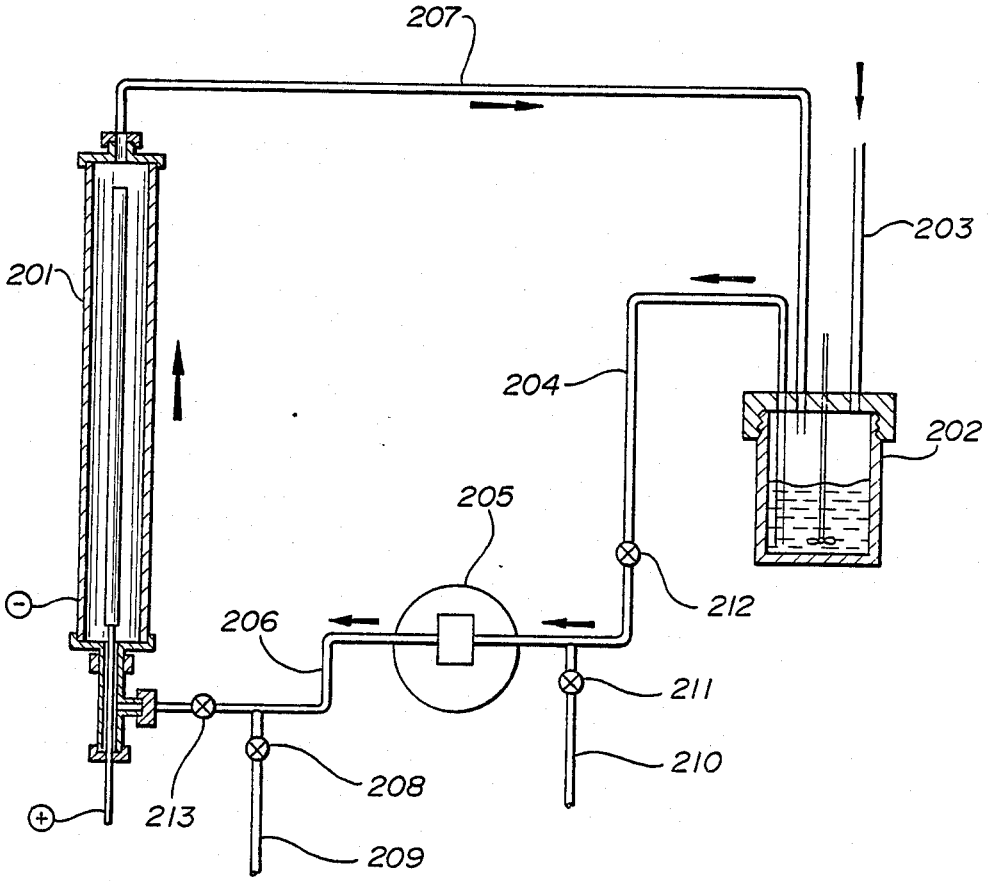
FIG. 2 is a schematic showing an overall arrangement for carbon monoxide tetramerization

FIG. 2 shows an overall system for the electrolytic tetramerization of carbon monoxide in which cell 201 is that described in FIG. 1. Referring to FIG. 2, there is provided stirred autoclave 202 made of corrosion and pressure resistant material such as stainless steel. Contained in autoclave 202 is the electrolyte solution maintained under continuous carbon monoxide pressure via line 203.

Electrolyte solution containing carbon monoxide is passed from autoclave 202 via line 204, gear pump 205, and line 206 to the inlet of cell 201. Said inlet is at 106 on FIG. 1.

As shown schematically in FIG. 2, the electrolyte containing carbon monoxide passes upwardly through the annular space defined by the cathode pipe (101 from FIG. 1) and the anode rod (102 from FIG. 1) while a direct current of electricity is passing from anode to the cathode, whereby the carbon monoxide undergoes electrolytic tetramerization. During the electrolytic conversion, the anode is consumed with formation of the squarate ion of the anode material—e.g., magnesium squarate where a magnesium anode is employed—as product.

The product-containing electrolyte passe out of the cell at 109 of FIG. 1 and is transported via line 207 to autoclave 202.

High circulation rates are maintained in order to avoid the accumulation of product solids as well as coproduct material in the system. It should be noted that viscous by-products are formed during the electrochemical reaction which have a tendency to deposit on electrode surfaces and interfere with operations. Problems associated with these by-products are substantially avoided through use of the apparatus of this invention, especially where the upright configuration of cell 101 is employed and high electrolyte solution circulation rates are maintained.

A portion of the circulating mixture is withdrawn via valve means 208 and line 209 and passes to product recovery and purification (not shown). The procedures set forth in U.S. Pat. No. 4,523,980 are illustrative of suitable and preferred recovery techniques.

Fresh electrolyte in amount necessary to balance that removed is added via line 210 and valve means 211.

Preferably, product is removed and make-up electrolyte is added continuously although semi-continuous or batch modes can be employed.

In especially preferred practice, a number of cells are provided in parallel. Since the anode is consumed during the electrolytic carbon monoxide tetramerization it is necessary from time to time to replace the anode in a particular cell. Where there are a number of cells in parallel, anode replacement can be carried out as a scheduled matter without disruption of the process. As shown in FIG. 2, a particular cell can be isolated by closing valve means 212 and 213 while other cells remain in operation. The isolated cell can be vented and the anode replaced quickly and conveniently as a matter of standard operation.

Figure 3:
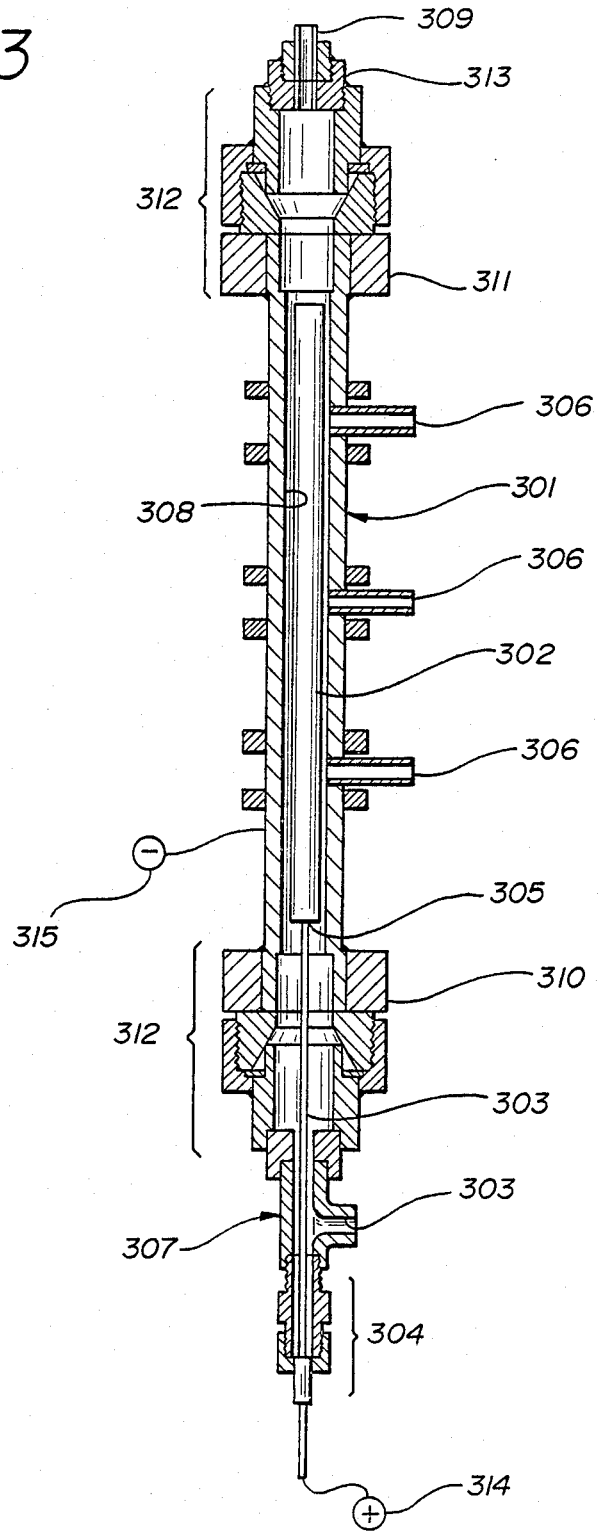
FIG. 3 is a sectional view of another embodiment of the electrolytic cell.

The electrolytic conversion of carbon monoxide is a very rapid reaction. Where low to moderate pressures of carbon monoxide are employed, e.g. 700 psi., in the apparatus shown in FIG. 1 the reaction tends to take place primarily near the end of the anode at the inlet point with anode attack in that zone. This can result in uneven conversion of the anode which can be a disadvantage in that more frequent anode replacement may be required. By raising the CO pressure, e.g. to about 1500 psi. or so, this uneven loss of anode can be substantially overcome At the higher CO pressures, more CO is available for reaction and fairly even anode attack over the entire length of the anode can be achieved Where both even anode attack and relatively low system pressures are desired, a cell configuration such as is shown in FIG. 3 can be employed. In this configuration, multiple inlet means 306 are provided along the cathode for parallel introduction of the electrolyte solution Low CO partial pressures and therefore low system pressures can be used while still achieving uniform anode consumption with cells having this configuration The invention is further illustrated by the following example.

EXAMPLE

A high pressure, continuous electrochemical reactor cell is constructed as described in FIG. 1 using, as a cathode, a 316 stainless steel schedule 40 pipe of 0.75 inch inner diameter It is fitted with flanges and pressure fittings such that the interior length is equivalent to a wetted surface area of 28.27 square inches.

As the anode, an 0.41 inch diameter magnesium rod is secured along the longitudinal center line of the cathode pipe by insulated positioning means. A threaded stainless steel current feeder rod is screwed into a threaded recovery hole in the anode. The pressure tight insulating Conax fittings are secured and tested to 1650 pounds per square inch gauge pressure with nitrogen.

The reactor is then connected to an electrolysis system as described by FIG. 2 using a 300 cubic centimeter, 316L stainless steel Autoclave Engineers Magnidrive autoclave as the carbon monoxide dissolution vessel; a Micropump Model 210 gear pump is connected to the loop to circulate the electrolysis solution The system is charged with 350 milliliters of isobutyronitrile and 12 grams of tetrabutyl ammonium iodide. The circulation pump is started at a setting determined previously to achieve a circulation rate through the reaction loop of 1600 milliliters per minute. The system is then pressured with CP grade carbon monoxide from cylinders via the dissolution tank to a system pressure of 1420 pounds per square inch gauge. The cell voltage is set at 10 volts and is applied from a filtered DC power supply unit, Model D-612T of Epsco Incorporated.

After 2 hours of closed loop operation the concentration of squaric acid in the circulating electrolysis solution reaches about 25 weight percent. At that point the bleed valve is opened to purge electrolysis solution at a rate of 75 milliliters per hour.

The purged solution is filtered; the solids ar accumulated and the filtrate is put into a glass burette from which the filtrate is pumped back into the electrolysis loop at essentially the same rate as the purge is withdrawn, using a Milton Roy Instrument Mini Pump.

The run is continued in this manner for a total of 14 hours. Over that period, the current passed amount to 1.165 Faradays. A total of 122.95 grams of solids are recovered.

The solids contain 31.83 grams of squaric acid, equivalent to 0.28 moles. The current efficiency of squaric acid production is therefore 47.9 percent.

I claim:

1. An electrolytic cell comprising (a) high pressure and corrosion resistant cathode means;

(b) consumable anode means positioned within said cathode means and adapted to be readily removed from the cell and replaced, said cathode and anode means together defining an electrolytic reaction zone;

(c) inlet means for continuous passage of liquid electrolyte containing solid reaction product from said zone;

(d) outlet means for continuous removal of liquid electrolyte containing solid reaction product from said zone; and (e) means for passing direct current from said anode means to said cathode means.

2. A system for the electrolytic conversion of carbon monoxide to squarate ion which comprises (a) the electrolytic cell of claim 1;

(b) means for continuously separating product-containing electrolyte; and (c) means for continuously transporting carbon monoxide and electrolyte to said cell.

3. The system of claim 2 comprising a plurality of electrolytic cells of claim 1 arranged in parallel.

4. The cell of claim 1 wherein said cell has a plurality of said inlet means (c) for passage of liquid electrolyte and carbon monoxide into said zone.

5. The cell of claim 1 wherein said consumable anode means is adapted to be threadedly advanced in said zone.

* * * * *